US006530750B2

(12) United States Patent
Mills

(10) Patent No.: US 6,530,750 B2
(45) Date of Patent: Mar. 11, 2003

(54) CONTROL FOR PROGRESSIVE CAVITY PUMP

(75) Inventor: Ernest Bennett Mills, Cambridge City, IN (US)

(73) Assignee: Hy-Flex Corp., Cambridge City, IN (US)

( * ) Notice: Subject to any disclaimer, the term of this patent is extended or adjusted under 35 U.S.C. 154(b) by 0 days.

(21) Appl. No.: 09/813,583

(22) Filed: Mar. 21, 2001

(65) Prior Publication Data

US 2001/0055528 A1 Dec. 27, 2001

Related U.S. Application Data

(60) Provisional application No. 60/191,032, filed on Mar. 21, 2000.

(51) Int. Cl.[7] ..... F04B 49/00
(52) U.S. Cl. ..... 417/26; 417/900; 222/63
(58) Field of Search ..... 417/12, 26, 44.2, 417/53, 900; 239/99, 106; 222/1, 63, 333

(56) References Cited

U.S. PATENT DOCUMENTS 5,549,465 A * 8/1996 Varadan ..... 418/48
5,878,921 A * 3/1999 Chase et al. ..... 222/333
5,992,686 A * 11/1999 Cline et al. ..... 222/1

OTHER PUBLICATIONS

Technical Specifications From the Internet:.
http://www.hyflexcorp.com/—P. 1–2.
http://www.shanleypump.com/allweilr.htm—P. 1.
http://www.shanleypump.com/pc.htm—P. 1.
http://www.shanleypump.com/eqstator.htm—P. 1.
http://www.shanleypump.com/pvjoint.htm—P. 1.
http://www.shanleypump.com/lobe.htm—P. 1.

* cited by examiner

*Primary Examiner*—Charles G. Freay
*Assistant Examiner*—Han L. Liu
(74) *Attorney, Agent, or Firm*—Brouse McDowell; Roger D. Emerson; Timothy D. Bennett

(57) ABSTRACT

A progressive cavity pumping system includes a pump housing, a rotor member operatively received in the pump housing, a prime mover coupled to the rotor member for driving the rotor member in first and second directions and a controlling means for actuating the prime mover, wherein the controlling automatically causes the rotor member to be driven in the second direction after shut down or idling of the pumping system. A method of operating the pumping system includes automatically driving the rotor member in a second direction after initiating shut down or idling of the pumping system and prior to start up of the same.

11 Claims, 3 Drawing Sheets

CONTROL FOR PROGRESSIVE CAVITY PUMP

This application claims priority from U.S. Provisional Application, Serial No. 60/191,032, filed on Mar. 21, 2000, titled CONTROL FOR A PROGRESSIVE CAVITY PUMP.

BACKGROUND OF THE INVENTION

A. Field of Invention

The present invention relates to the art of slurry pumping devices and more specifically to progressive cavity pumps and pumping systems.

B. Description of the Related Art

Currently in the art progressive cavity pumps are known to dispense a slurry or aggregate material, such as cement, stucco or synthetic coatings. The aggregate material is received through a material inlet and is metered through the barrel of the pump by the rotating action of an internal rotor. The rotor builds pressure at the dispensing end where the aggregate material is then ejected under pressure through a spray gun. When the pump is shut off or idled pressure is trapped in the barrel and in a hose connecting the barrel to the spray gun. Under pressure, the aggregate material is subjected to "dry packing" wherein the more viscous material of the slurry is separated from the aggregate leaving drier and more condensed material in the barrel. This can lead to increase wear of the pump components, including the pump barrel and the rotor, especially during start up. What is needed is a pump that reduces the pressure in the barrel, the hose and the spray gun, after shut down or idling of the pump, thus preventing separation of the aggregate material.

SUMMARY OF THE INVENTION

It is an object of the present invention to provide a method for starting up a pumping system wherein a rotor member is automatically driven in second direction for a selectively adjusted amount of time prior to driving the rotor member in a first direction, wherein the driving the rotor member in a first direction causes a dispensing of an associated aggregate material.

It is another object of the present invention to provide a method for shutting down a pumping system wherein a rotor member is automatically driven in second direction for a selectively adjusted amount of time after initiating shutdown or idling of the pumping system from being driven in a first direction.

It is even another object of the present invention to provide a pumping system, and more specifically a slurry pumping system that automatically reduces the pressure in the pump housing by reversing the rotor member contained therein for a predetermined amount of time during shutdown of idling of the pumping system.

It is another object of the present invention to provide a pumping system, and more specifically a slurry pumping system that automatically reverses the direction of the rotor member for a predetermined amount of time during start up of the pumping system.

It is yet another object of the present invention to provide a prime mover that drives the rotor member in first and second directions.

It is still another object of the present invention to provide a controlling means that actuates the prime mover.

It is still yet another object of the present invention to provide a controlling means that automatically causes the rotor member to be driven in a second direction after initiating shutdown of the pumping system and prior to start up of the pumping system.

In accordance with the present invention, there is provided a pumping system that includes a pump housing and a rotor member received within the pump housing, wherein the rotor member is driven in a first direction to dispense an associated aggregate material. The pumping system further comprises a prime mover operatively coupled to the rotor member for use in driving the rotor member in first and second directions. The prime mover is operatively communicated to and driven by a controlling means that automatically drives the rotor member the second direction after shut off or idling of the pumping system is initiated. The controlling means also automatically drives the prime mover, and consequently the rotor member in the second direction for a predetermined amount of time when the shutting down of the pumping system is initiated. The time period for driving the rotor member in the second direction is selectively determined by a first potentiometer operatively communicated to the controlling means and adjusted by the operated to the desired length of time. During shut down of the pumping system, while the pumping system is operating, the operator adjusts the first potentiometer, then initiates shutdown of the pumping system, after which the controlling means automatically reverses the direction that the rotor member is driven for the predetermined period of time set by the first potentiometer. In this way the pressure in the dispensing end or second of the pump housing is reduced preventing or reducing the affects of material separation due to dry packing.

Other objects and advantages of the invention will appear from the following detailed description of the preferred embodiment of the invention with reference being made to the accompanying drawings.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

DESCRIPTION OF THE PREFERRED EMBODIMENT

Figure 1:
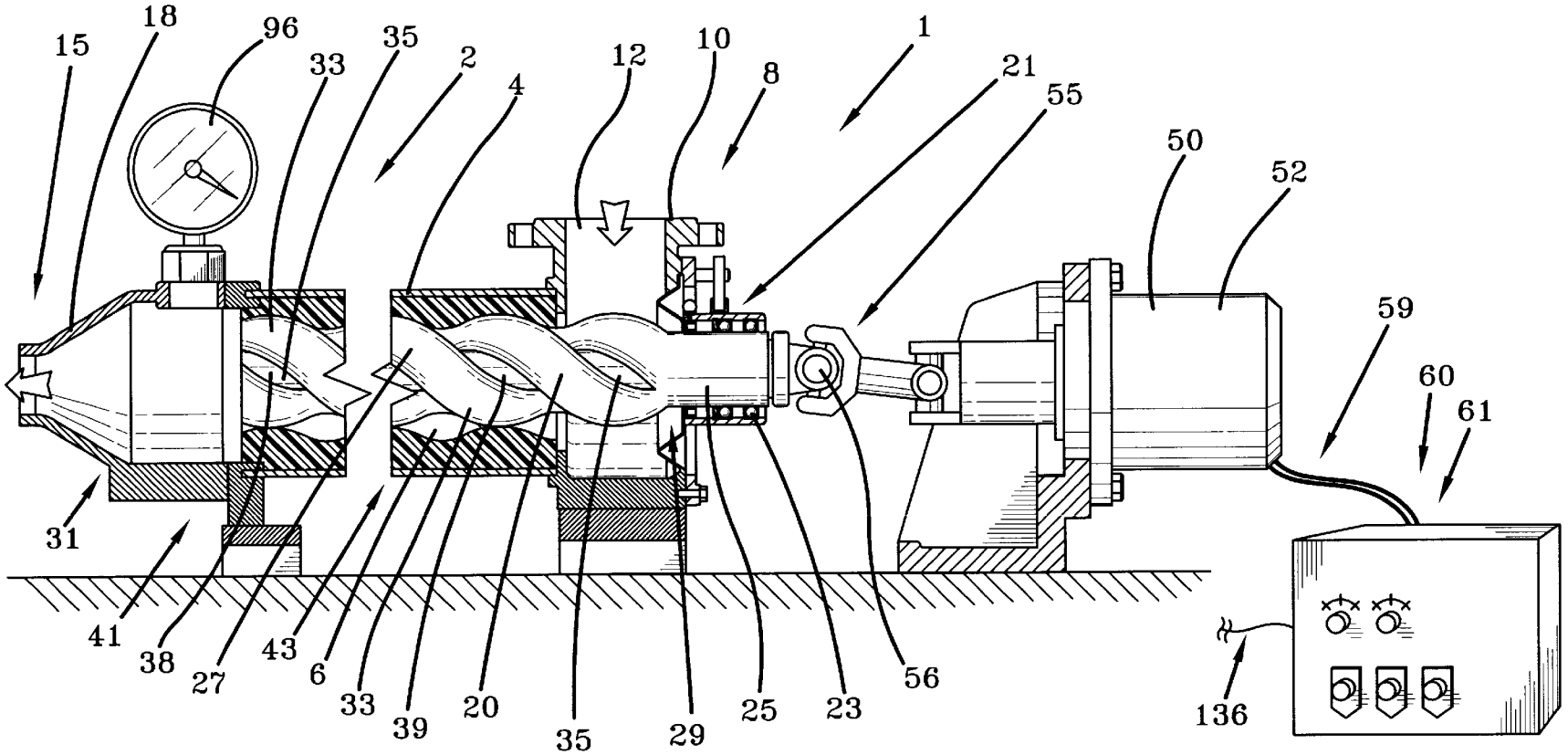
FIG. 1 is a side cutaway view of a progressive cavity pump showing the controlling means.
Figure 1A:
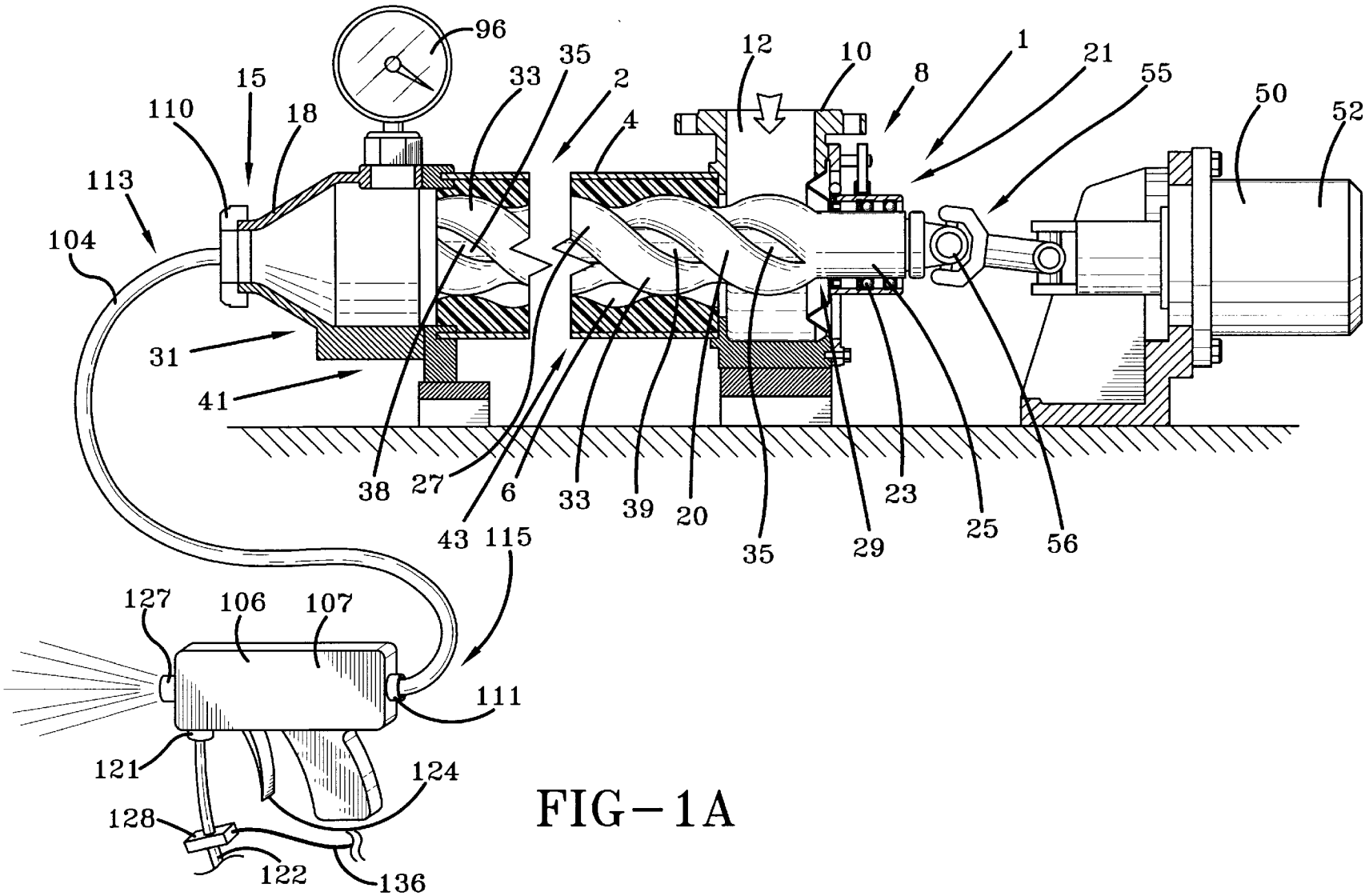
FIG. 1A is a side cutaway view of a progressive cavity pump showing the spray gun.

Referring now to the drawings wherein the showings are for purposes of illustrating a preferred embodiment of the invention only and not for purposes of limiting the same, FIGS. 1 and 1A depicts a pumping system shown generally at 1 for use in pumping an associated aggregate material such cement or stucco, not shown in the figures. The pumping system 1 includes a pumping unit 2 that is generally elongate having a pump housing 4. The pump housing 4 defines an inner cavity 6 that may be pressurized in a manner well known in the art of pumps and pumping systems of this kind. At a first end 8 of the pump housing 4, a material inlet 10 is shown communicating the exterior of the pump housing 4 with the cavity 6. The material inlet 10 includes a first opening 12 that receives and funnels the associated aggregate material into the cavity 6 of the pump housing 4 during normal operation of the pumping system 10. At a distal end or second end 15 of the pump housing 4, a material outlet 18 is shown communicating the cavity 6 with the exterior of the pump housing 4. Operatively attached to the material outlet 18 is a hose 104 that communicates the associated aggregate material to a dispensing means 106, which in the preferred embodiment is a spray gun 107. The dispensing means 106 also receives a pneumatic supply of pressurized air, as will be discussed further in greater detail. The supply of air is used to assist in dispensing the aggregate material from the dispensing means 106. In this manner, the associated aggregate material is fed into the pump unit 2 via the material inlet 10 and is past through the material outlet 18 under pressure where it is communicated to and dispensed from the dispensing means 106. It is especially noted, that the pumping system 1 of the present invention is progressive cavity pump. However, the features of the present invention are applicable to any pumping system as described herein.

With continued reference to FIGS. 1 and 1A, a rotor member 20 is shown as received at least partially within the pump housing 4. The rotor member 20 is generally elongate and extends axially out of pump housing 4 at the first end 8 through an aperture 21 fashioned therein. At the first end 8 of the pump housing 4, bearings 23 are operatively received within the pump housing 4 to rotationally connect the rotor member 20 with respect. to the pump housing 4. The rotor member 20 may be comprised of two axially juxtaposed sections: a cylindrical section 25 and an auger section 27. The cylindrical section 25 is disposed toward the first end 8 of the pump housing 4 and is operatively received by the bearings 23 as previously discussed. The first end 29 of the auger section 27 is juxtaposed to the cylindrical portion 25 at a position generally below the material inlet 10 and extends longitudinally into the cavity 6 where it terminates at the second end 31 of the auger section 27, which is disposed at the distal or second end 15 of the pump housing 4. The auger section 27 of the rotor member 20 includes helically shaped flights 33 that spiral down the length of the auger section 27 in a right-handed manner, as will be discussed in further detail in a subsequent paragraph. The flights 33 have an outer diameter that is slightly less than the inner diameter of the pump housing 4. Furthermore, the flights 33 are separated by channels 35 that have an outer diameter substantially less than that of the outer diameter of the flights 33. In this way, the channels 27 form a pathway within the cavity 6 that meter the aggregate material down the length of the pump housing 4 as the rotor member 20 is rotated in a first direction in a manner well known in the art. The associated aggregate material is subsequently discharged from the second end 15 of the pump housing 4 through the material outlet 18 to the hose 104 under pressure as generated by the pumping system 1. The hose 104 may be constructed of any type of material chosen with sound engineering judgment that is appropriate for receiving an aggregate material. The hose 104 may also be flexible and of sufficient length so as to allow an operator to maneuver the spray gun 107 during operation. The first end 113 of the hose 104 is operatively connected to the material outlet 18 via coupling means 110 in a manner chosen with sound engineering judgment. The second end 115 of the hose 104 is operatively connected via connector means 111 to the spray gun 107. In this way, the hose 104, coupling means 110 and the connector means 111 convey the pressurized aggregate from the pumping housing 4 to the dispensing means 106 in a way that allows the operator to guide the spray gun 107 as desired. The coupling means 10 and the connector means 111 may include threaded portions, not shown, that fasten onto threaded receiving members, also not shown, for use in selectively and fixedly attaching the hose 104 to the pump housing 4 and spray gun 107 respectively. During activation of the dispensing means 106 or spray gun 107, from which the aggregate material is dispensed, the aggregate material is continuously introduced into the pump housing 4 via material inlet 10, which is then pressurized by the pumping system 1 and conveyed through the hose 104 and spray gun 107 respectively. When the spray gun 107 is deactivated, the pumping system 1 is idled, as will be subsequently discussed. However, the aggregate material remains pressurized in the hose 104 and in the second end or second region 41 of the pump housing 4. In other words, when the pumping system 1 is idled, the second region 41 is pressurized with respect to the first region 43. It is noted that while the preferred embodiment of the present invention includes a rotor member that is helically shaped member having flights and channels, any pumping device or member may be used that meters the aggregate material down the length of the pump housing 4.

With continued reference to FIG. 1A, the dispensing means 106 or spray gun 107 includes a pneumatic connection port 121. The pneumatic connection port 121 operatively receives a supply line 122 in a manner well known in the art that conveys pressurized air from an air source, such as an air compressor, not shown, to the spray gun 107. The spray gun 107 may include a piston, not shown, that is displaced by engaging an activating means, which may be a spray gun trigger 124 shown clearly in FIG. 1A. When the trigger 124 is engaged, the piston is displaced allowing the aggregate material flow into the spray gun 107. Simultaneously, upon engaging the trigger 124, pressurized air is also caused to flow into the spray gun 107 where it mixes with the aggregate material and is dispensed through the nozzle 127. When the trigger 124 is released or deactivated, the aggregate material and the flow of pressurized air ceases. In this manner, depressing the trigger 124 causes the aggregate material to be dispensed with the assistance of the pneumatic air and releasing the trigger 124 stops the flow of the aggregate material through the spray gun 107. In other words, the activating means activates and deactivates the controlling means 60.

With continued reference to FIG. 1, a prime mover 50 is shown in operative connection with the pumping unit 2. In the preferred embodiment, the prime mover 50 is an electric motor 52. An alternate embodiment is contemplated where the prime mover 50 may be a hydraulic motor, not shown. However, any means of driving the rotor member 20 may be chosen in accordance with sound engineering judgment. The prime mover 50 is operatively connected to the rotor member 20 at the cylindrical section 25 via coupling 55. The coupling 55 may comprise a universal type joint 56 that allows rotational power to be transmitted from the prime mover 50 to the rotor member 20. In that couplings and universal joints are well known in the art no further explanation will be offered at this point. The electric motor 52 may be a DC motor that provides rotational power both clockwise and counterclockwise. Electrical conductors 59 communicate control signals from a controlling means 60 as will be discussed in greater detail in the following paragraph. In this manner, the rotor member 20 may be selectively driven in first and second directions as powered by the prime mover 50, which is operated via the controlling means 60 as will be presently discussed.

Figure 2:
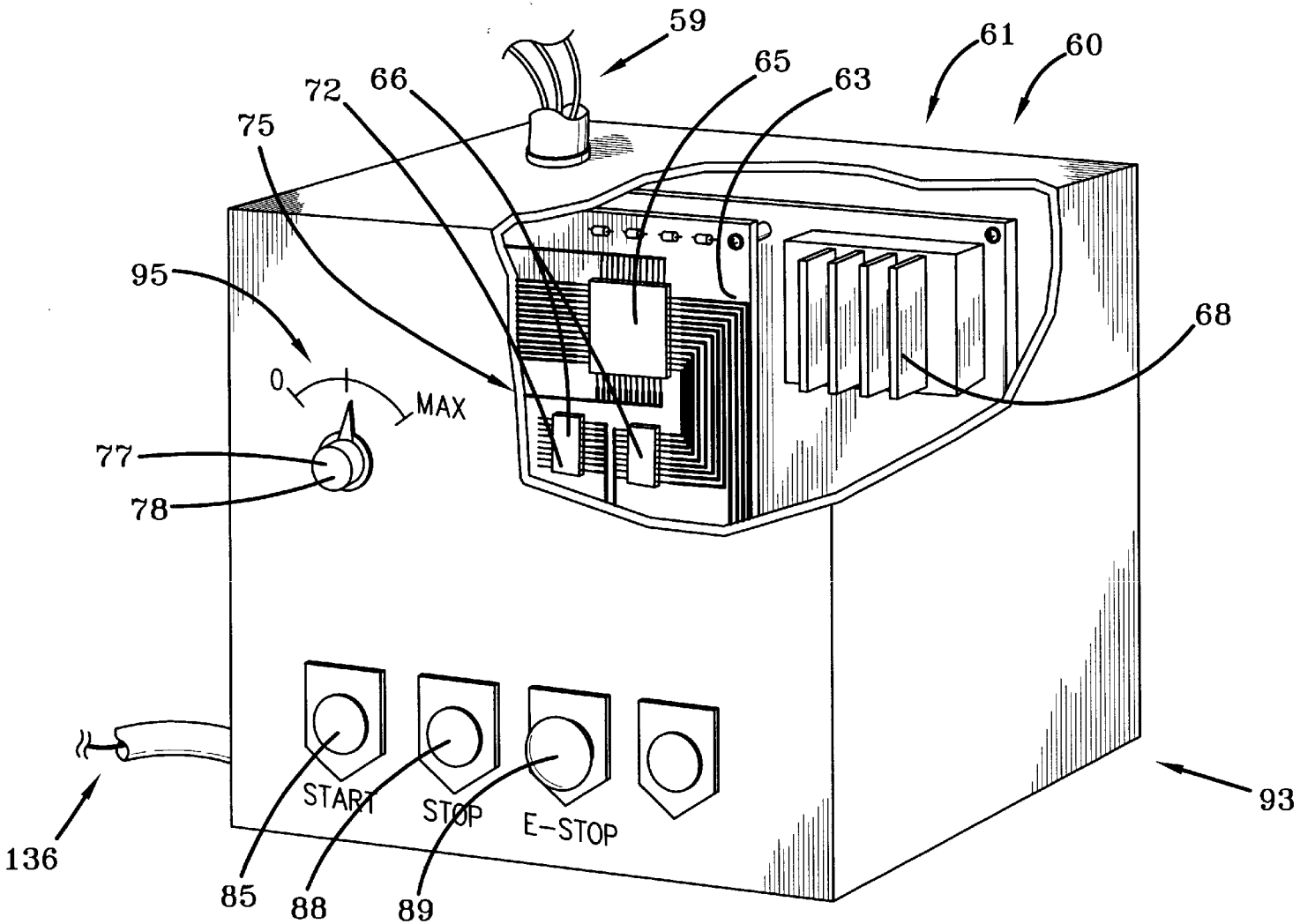
FIG. 2 is a front partial cutaway view of a controlling means.

With reference now to FIG. 2, a controlling means is shown generally at 60. In the preferred embodiment, the controlling means is a logic-based controller 61. The logic-based controller 61 may include a main circuit board 63 onto which mounts at least one microprocessor 65 and a plurality of support chips 66. The term "chips" refers to electronic circuitry packaged in the form of Integrated Circuits. The microprocessor 65 performs the logic functions as required to automatically control the pumping system 1 which will be discussed in further detail in subsequent paragraphs. The controlling means 60 may also include an electric motor controller 68 for use in providing signal power to drive the electric motor 52. The logic-based controller 61 is electronically communicated to the motor controller 68 in a manner well known in the art and will therefore not be discussed further at this point. As the logic-based controller 61 processes the control logic for operating the pumping system 1, command signals are communicated to the motor controller 68 indicating the speed and direction that the motor controller 68 is to drive the electric motor 52. In this way, the controlling means 60 drives the prime mover 50 in first and second directions as dictated by the controlling means 60, which in turn rotates the rotor member 20 in first and second direction accordingly. In that motor controllers and control logic are well known in the art, no further explanation will be offered at this point.

With continued reference to FIG. 2, the support chips 66 of the controlling means 60 may include memory chips 72 frequently referred to as "RAM", in which are stored logic commands to be processed by the microprocessor 65. The memory chips 72 may store any preprogrammed sequence to be processed by the microprocessor 65 that will affect operation of the pumping system 1 in accordance with the operating features of the present invention, as will be discussed subsequently. It is noted that "RAM" refers to volatile memory, the selectively programmed contents of which may be erased after electric power is disconnected from the memory device. It is also noted at this point that any type of support chips, memory chips or information storage devices may be used in conjunction with the microprocessor, as chosen with sound engineering judgment including non-volatile memory chips commonly referred to as "ROM". In that the operative communication of memory chips 72, support chips 66 and microprocessors 65 are well known in the art, no further explanation will be offered at this point.

In the preferred embodiment, the memory chips 72 may store selectively programmed sequences of commands, shown generally at 75, that are processed by the logic-based controller 61 for signaling the motor controller 68 to drive the electric motor 61, which in turn drives the rotor member 20. The logic-based controller 61 may receive input from an operator that affects the operation or timing of the programmed sequence of commands 75. In the preferred embodiment, a first potentiometer 77 is operatively communicated to the logic controller 61 so that selective adjustment of the first potentiometer 77 may increase or decrease the duration that the motor controller 68 drives the rotor member 20 in an intended direction. In other words, the potentiometer 77 serves as a timer 78, which determines how long the rotor member 20 is driven in a second direction, which will be discussed in greater detail in the following paragraphs. The controlling means 60 may also include a "Start" push button 85 and "Stop" push button 88, as well as "Emergency Stop" push buttons 89, each of which are operatively communicated to the logic-based controller 61 in a manner well known in the art. The "Start" push button may serve to engage the controlling means 60, while the "Stop" push button may serve to disengage the controlling means 60 during the "Shut down" sequence. It is noted at this point that any controlling means may be used with sound engineering judgment that controls the operating sequence of the pumping system 1 including relay-logic, pneumatic-logic and/or hydraulic-logic. Additionally, any prime mover 50 may be chosen with sound engineering that is in operable communication with the controlling means 60, including hydraulic motors or mechanical gearing means, that will drive the rotor member 20 in accordance with the description of the present invention.

With reference now to FIGS. 1 and 2, the operation of the pumping system 1 will now be discussed. As previously stated, the preferred embodiment relates to a progressive cavity pumping system. However, the present invention is applicable to any slurry-dispensing device wherein material pressure is trapped within the pump housing upon idling or disengaging the pumping system. The pumping system 1 may dispense an associated aggregate material, such as cement or stucco. Initially the operator connects power to, or in other words "turns on", the pumping system 1 via a power switch, not shown, which supplies operating power to the pumping system 1. In the case of an electric controlling means, electric power would be supplied to the pumping system 1. The power switch of an alternate embodiment controlling means may supply pneumatic power to the controlling means. Any manner of powering up and starting the pumping system may be chosen with sound engineering judgment as is appropriate for a controlling means 60. Operation of the pumping system 1 would proceed with engaging the prime mover 50 to drive the rotor member 20 in a clockwise manner or in a first direction. The clockwise or first direction is so indicated because, with relation to screw threads, and more specifically to "right handed" screw threads, the rotor member 20 includes helical flights 33 that spiral down the length of the rotor member 20 in a right hand manner. Therefore, driving the rotor member 20 in the first direction will meter the associated aggregate material down the length of the rotor member 20 and dispense the aggregate material through the material outlet under pressure. When the pumping system 1 is disengaged, or in other words when the rotor member 20 is not rotationally driven, the associated aggregate material in the second region 41 remains pressurized with respect to the first region 43. In this manner, pressure is trapped in the second region 41 causing the associated aggregate material to "Dry Pack". Dry packing refers to the fact that an aggregate material under pressure will separate out the less viscous components of the aggregate material leaving a drier, more condensed composite.

With continued reference to FIGS. 1 and 2, disengaging the pumping system 1 will now be discussed. In the one embodiment, the operator would depress the "Stop" button 88, which would in turn electrically indicate to the controlling means 60 that a shut down sequence should be engaged. During the shut down sequence, the controlling means 60 would automatically arrest the motion of the rotor member 20 by disengaging the prime mover 50 from rotationally driving the rotor member 20 in the first direction and would signal the prime mover 50 to rotationally drive the rotor member 20 in the counterclockwise or second direction for predetermined period of time as selectively set by adjusting the first potentiometer 77 to a desired level, the operation of which will be discussed shortly. In other words, the controlling means 60 would reverse the direction that the rotor member 20 is being driven for a selective period of time as determined by the value of the first potentiometer 77, which would consequently reduce the pressure of the associated aggregate material in the second region 41. In this manner, the pressure of the aggregate material in the second region 41 is reduced with respect to the first region 43, reducing the affects of "Dry Packing" while the rotor member 20 remains idle. It is expressly noted that the sequence of reversing the direction of the rotor member 20 for predetermined period time is enacted automatically without additional action from the operator, once the "Stop" button 88 has been depressed. After the rotor member 20 has been reversed for a predetermined amount of time, the rotor member 20 would remain idle until engaged at a future time by the operator.

With reference now to FIG. 2, the first potentiometer 77 is shown attached to the enclosure 93 that houses the controlling means 60. Potentiometers are electrical devices that change electrical resistance when selectively adjusted between minimum and maximum settings. The first potentiometer 77 is operatively communicated to the logic-based controller 61 in a manner well known in the art. In the preferred embodiment, the first potentiometer 77 functions as an adjustable timer in that the electrically resistive value communicated to the logic-based controller 61 is translated into a time value for which the prime mover 52 is to be actuated during the shut down sequence. In this way, the rotor member 20 is driven in the second direction for the predetermined time period as set by the value of the first potentiometer 77. The front of the enclosure 93 may have labeled thereon a timing indicator 95 that clearly shows how much time is being pre-selected by the operator. In shutting down the pumping system 1, the operator would selectively adjust the value of the first potentiometer 77 corresponding to the desired amount of time that the operator wants to drive the rotor member 20 in the second direction. The operator would then depress the "Stop" button 88 to disengage the pumping system 1. The controlling means 60 would automatically arrest the motion of the rotor member 20 and drive the rotor member 20 in the second direction for the time period corresponding to the value set on the first potentiometer 77. It is especially noted that any means of preselecting and communicating a timer value to the controlling means 60 for the purpose of driving the rotor member 20 in a second direction may be chosen with sound engineering judgment.

With reference again FIGS. 1A and 2, an alternate embodiment will now be discussed. A sensing means 128 may be placed in operable communication with the supply line 122 in such a manner that the sensing means 128 detects changes in the airflow pressure of the supply line 122. The sensing means 122 may include an electrical sensor output line 136 that is operatively communicated to the controlling means 60. Engaging the spray gun trigger 124 causes pressurized air to flow from the through the supply line 122 to the spray gun 107. The sensing means 128 detects the change in airflow pressure and communicates a signal via the electrical sensor output line 136 to the controlling means 60. The controlling means 60 would process the signal generated from the sensing means 128 to operate the prime mover 50 in a manner as previously discussed. Disengaging the spray gun trigger 124 would similarly cause the sensing means 128 to sense the change in the airflow pressure of the supply line 122 and signal the controlling means 60 to idle the prime mover 50 and consequently the rotor member 20. In other words, activating the spray gun 107, and more specifically depressing the spray gun trigger 124, causes the rotor member 20 to rotate which feeds pressurized associated aggregate material through the gun, which is dispensed through the nozzle 127 with the assistance of the pneumatic air. Likewise, deactivating the spray gun 107 idles the prime mover 50 and the rotor member 20. When the spray gun 107 is deactivated and the sensing means 128 communicates a signal to the controlling means 60 to arrest the motion of the prime mover 50 and the rotor member 20, the controlling means 60 automatically enters the shut down sequence where the prime mover 50 and rotor member 20 are driven in a second direction for the duration of time as indicated by the first potentiometer 77 in the manner as previously discussed. In this manner, depressing the spray gun trigger 124 causes the aggregate material to be dispensed and releasing the trigger 124 arrest the motion of the rotor member 20 which stops the flow of aggregate material to the spray gun 107 and reverses the rotor member 20 for a predetermined amount of time. This reduces the pressure in the second region 41 with respect to the first region 43 and reduces pressure in the hose 104 and spray gun 107. It is noted that should the first potentiometer 77 be set to a sufficiently large time setting that during shut down mode, the aggregate material may be drawn back out from or sucked out the spray gun 107 and hose 104.

While specific embodiments of the invention have been described and illustrated, it is to be understood that these embodiments are provided by way of example only and that the invention is not to be construed as being limited thereto but only by proper scope of the following claims.

I claim:

1. A pumping system for use in pumping an associated aggregate material comprising:

a pump housing having a material inlet and a material outlet, wherein said pump housing defines a cavity having first and second regions, wherein said first region is juxtaposed to said material inlet, and wherein said second region is juxtaposed to said material outlet;

a dispensing means for use in dispensing said associated aggregate material, said dispensing means operatively connected to said material outlet;

a rotor member operatively received at least partially within said pump housing, said rotor member being selectively rotatable with respect to said pump housing, wherein when said rotor member is driven in a first direction said associated aggregate material is pressurized in said second region with respect to said first region, and wherein when said rotor member is arrested from being driven in a first direction said associated aggregate material in said second region remains pressurized with respect to said first region, and wherein when said rotor member is driven in a second direction said pressure of said associated aggregate material in said second region is substantially reduced with respect to said first region;

a prime mover operatively coupled to said rotor member for use in driving said rotor member in first and second directions;

a controlling means operatively communicated to said prime mover, wherein when said controlling means is disengaged said controlling means automatically drives said prime mover in said second direction; and, an activating means for use in disengaging said controlling means, wherein said activating means is operatively connected to said dispensing means.

2. The pumping system of claim 1, wherein when said controlling means is disengaged, said controlling means automatically drives said rotor member in said second direction for a predetermined amount of time.

3. The pumping system of claim 2, further comprising:

a timing means operatively communicated to said controlling means for use in controlling said length of time that said controlling means drives said rotor member in said second direction.

4. The pumping system of claim 3, wherein said timing means is selectively adjustable.

5. The pumping system of claim 4, wherein said timing means comprises at least a first potentiometer.

6. The pumping system of claim 1, wherein said prime mover is an electric motor.

7. The pumping system of claim 6, wherein said controlling means comprises a microprocessor.

8. The pumping system of claim 1, further comprising:

dispensing means for use in dispensing said associated aggregate material, said dispensing means operatively connected to said material outlet;

activating means for use in disengaging said controlling means, said activating means operatively connected to said dispensing means; and, wherein when said activating means is deactivated, said controlling means automatically drives said prime mover in said second direction.

9. The pumping system of claim 1, further comprising:

a sensing means for use in sensing deactivation of said activating means, said sensing means operatively connected to said activating means, wherein said sensing means is in operable communicated with said controlling means; and, wherein said sensing means selectively communicates a signal to disengage said controlling means.

10. The pumping system of claim 9, wherein said sensing means is an airflow pressure sensor.

11. The pumping system of claim 1, wherein said dispensing means is a spray gun, and, wherein said activating means is a spray gun trigger.

* * * * *